US005499810A

United States Patent [19]

Tranquilla

[11] Patent Number: 5,499,810

[45] Date of Patent: Mar. 19, 1996

[54] PINCH-ROLL WITH FLOATING DAMPER

[75] Inventor: Michael N. Tranquilla, Livonia, Mich.

[73] Assignee: Unisys Corporation, Blue Bell, Pa.

[21] Appl. No.: 516,727

[22] Filed: Aug. 18, 1995

Related U.S. Application Data

[63] Continuation of Ser. No. 167,384, Dec. 14, 1993, abandoned.

[51] Int. Cl.[6] ..... B65H 5/06

[52] U.S. Cl. ..... 271/274; 226/187

[58] Field of Search ..... 271/272, 273, 271/274; 226/181, 186, 187

[56] References Cited

U.S. PATENT DOCUMENTS

| | | | |
|---|---|---|---|
| 4,061,332 | 12/1977 | Baumgartel et al. | 271/274 |
| 4,163,550 | 8/1979 | Armstrong | 271/274 |
| 4,875,670 | 10/1989 | Petersen et al. | 271/273 |
| 4,997,179 | 3/1991 | Mizutani et al. | 271/274 |
| 5,044,624 | 9/1991 | Haus et al. | 271/274 |
| 5,265,869 | 11/1993 | Morita | 271/274 |
| 5,303,913 | 4/1994 | Tranquilla | 271/274 |

FOREIGN PATENT DOCUMENTS

| | | | |
|---|---|---|---|
| 1263340 | 5/1961 | France | 271/274 |
| 0272734 | 11/1988 | Japan | 271/274 |
| 5069980 | 3/1993 | Japan | 271/274 |
| 2238525 | 6/1991 | United Kingdom | 271/274 |

*Primary Examiner*—H. Grant Skaggs

*Attorney, Agent, or Firm*—John J. McCormack; Mark T. Starr

[57] ABSTRACT

A document transport array, including pinch roll, which accommodates varied inter-document gaps, and varied-thickness documents, pinch roll including a moveable roll mounted on a yoke Which is spring-mounted by a spring flexure to allow this roll to be resiliently thrust away from the document path, this yoke means also including a resilient-pad absorber suspended therefrom and adapted to absorb energy and minimize motion developed normal to this path, thus enabling the moveable pinch roll to better maintain contact with a transported document.

15 Claims, 2 Drawing Sheets

FIG. 2
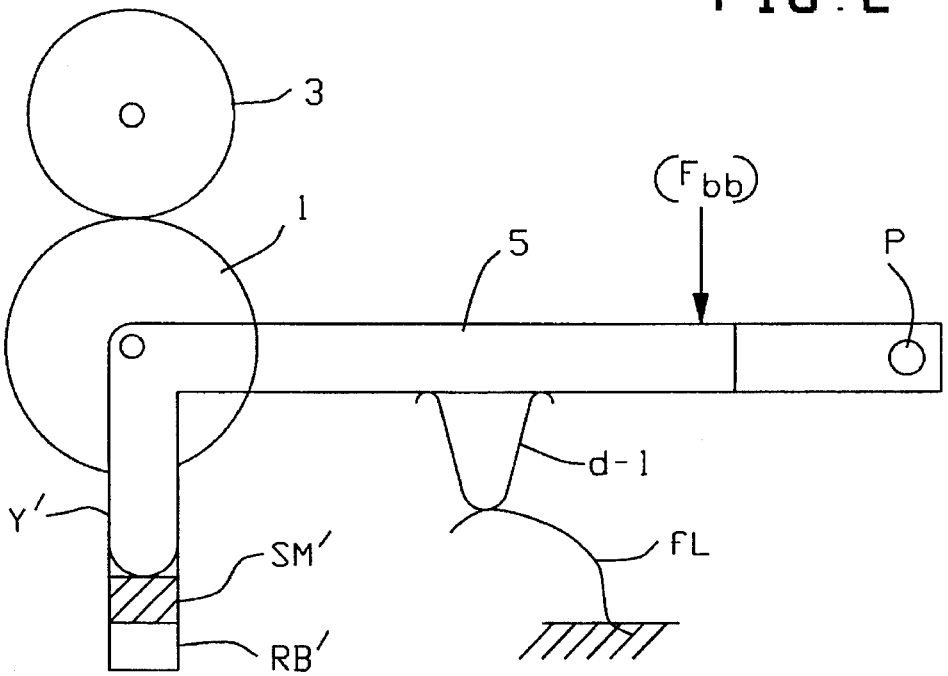
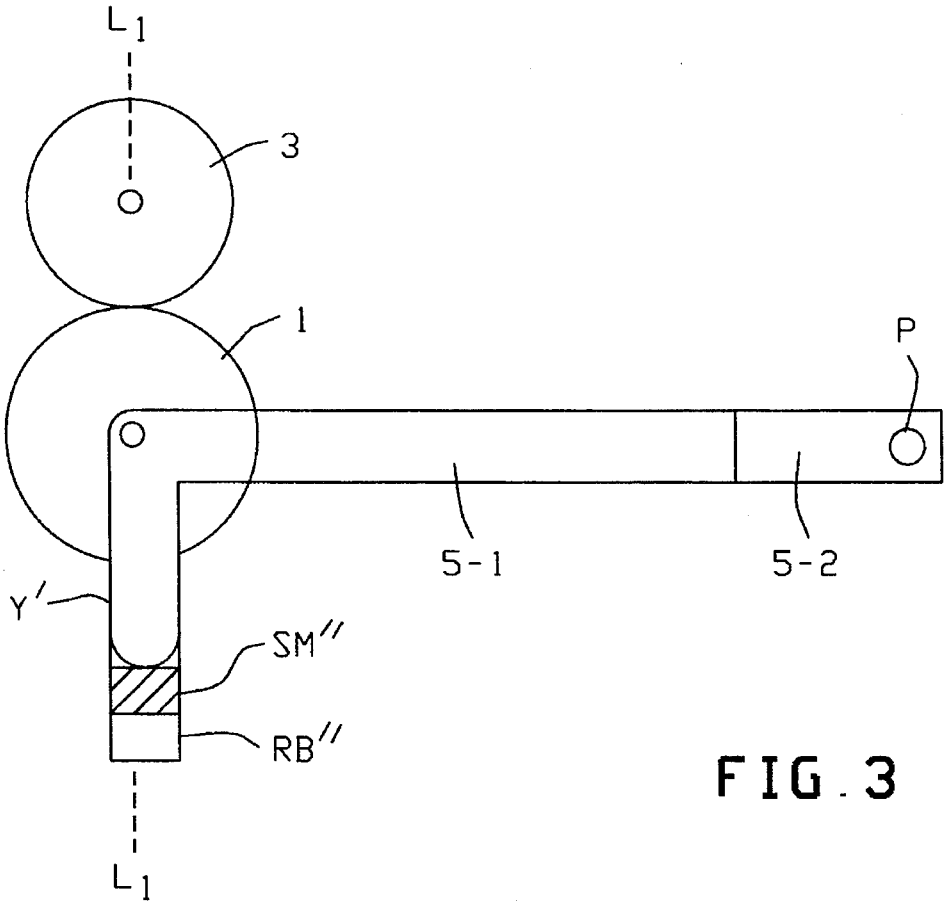
FIG. 3

PINCH-ROLL WITH FLOATING DAMPER

This application is a continuation, of application Ser. No. 08/167,384, filed Dec. 14, 1993, now abandoned.

This invention relates to document transport equipment, and especially to a pinch roll therefor which includes "floating" bounce-damping means.

BACKGROUND, FEATURES

Workers are aware that new and innovative high speed document transport systems are eagerly pursued at present. One problem using such is that when pinch rolls are employed, the "moveable roll" is apt to "bounce" away from document when meeting a document having a "bulge" (e.g. large staple or fold thereon). And such a bounce can undesirably leave the document poorly driven, since this moveable roll is normally spring-biased vs. its companion driving-roll, as workers know.

This invention avoids such problems, and includes "floating damper" means for damping the movable pinch roll (e.g. for documents of irregular thicknesses, and/or for unusual protrusions on the document such as staples). Thus, one object hereof is to minimize transient motions of the movable pinch roll normal to the document transport direction, so that the pinch rolls remain more in intimate contact with the document, even under "bounce conditions".

As a feature hereof, such floating-damping is provided through use of a flexible damping material, such as polyurethane, plus a suitable floating-backing.

Such a floating damper is of particular interest for minimizing bounce of a movable pinch-roll on an arm cantilevered-out to be spring-biased against the drive roll. This arm may, itself, be resilient (e.g. a flexure arm).

Thus, it is also an object hereof to address (at least some of) the aforementioned problems, and to provide the hereincited advantages and functions. A related object is to provide a moveable pinch-roll mounted on a spring-biased pivot arm, where "roll-bounce" is minimized by floating damper means.

The methods and means discussed herein, will generally be understood as constructed and operating as presently known in the art, except where otherwise specified; and with all materials, methods and devices and apparatus herein understood as implemented by known expedients according to present good practice.

DESCRIPTION OF FIGURES

FIG. 2 is a side view of a like arrangement modified to use a rigid arm with ancillary spring bias means; and FIG. 3 is a view as in FIG. 2 of a like arrangement with the bias applied directly along the roll-nip.

PREFERRED EMBODIMENT

Figure 1:
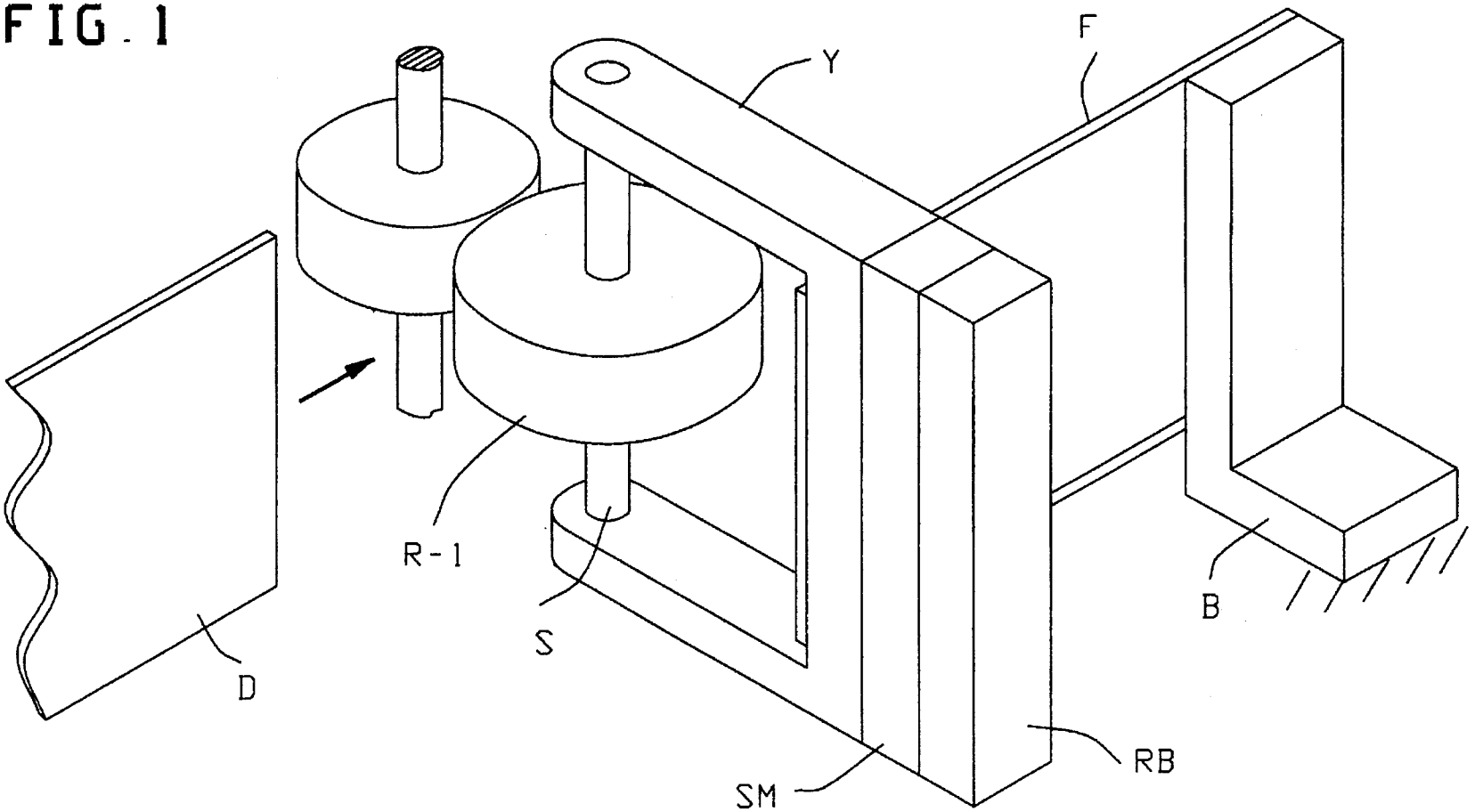
FIG. 1 is a very schematic elevation of a preferred pinch roll embodiment, with floating bounce-damper means.

FIG. 1 depicts a moveable pinch roll R-1 opposed by a fixed drive roll R-2 which may be assumed as rotated about its center by any number of known contemporary means. Normally, a document D is moved at high speed to the nip between this roll pair by known upstream document feed means (eg. a feeder, or another upstream roll assembly, not shown—e.g. in a high-speed check-sorter). And the document will be withdrawn from this roll assembly R-1, R-2 to output means, such as another downstream roll pair or to a stacker (neither shown, but well known in the art).

Moving pinch roll R-1, is cantilevered-out on a flexure arm F which is free to pivot about a fixed end (eg. on bracket B fixed on the machine frame). Pinch roll R-1 is free to rotate with respect to its shaft S (e.g. with sealed ball bearings to minimize friction and prevent paper dust accumulation in the bearing.) Shaft S is fixed between arms of a yoke Y in which it is journaled.

Alternatively, the roller may be fixed on shaft S and the shaft free to rotate with respect to the yoke, again usually with sealed ball bearings. Yoke Y is affixed on the free end of flexure arm F, whose other end is fastened to a rigid bracket B. Flexure F provides the nominal pinch force at the nip between rolls R-1, R-2. A "dynamic absorber" concept can be applied to this, or other related constructions as well.

The dynamic absorber here, preferably consists of spring means SM attached to yoke Y at its distal end, opposite the nip, plus a rigid backing-block RB attached to the other side of spring SM. Spring SM is flexible in the nip direction (perpendicular to the direction of document transport) and may preferably comprise an elastomer. Less preferably, it may be a compression spring, or another flexure, etc.

As the leading edge of a document, or a bulge (e.g. with a protruding fold, staple, etc.), enters the nip (pinch point), pinch roll R-1 will be apt to "bounce away" from the drive roll in a direction transverse the document transport direction. The "bounce-energy" that is thereupon imparted to the roller assembly, (here consisting of pinch roll R-1, shaft S and yoke Y), may, instead, be given to my "dynamic absorber", here consisting of the elastomer spring SM and block RB. These will undergo harmless compression/motion instead of the roller assembly, so that the subject "bulging" document can tend to remain in better, more intimate contact with the two pinch rollers.

More particularly, this "document-edge or bulge" will instantaneously throw roll R-1 and yoke Y, along with the free tip of flexure arm F, away from document to instantaneously begin to compress elastomer SM—with high-inertia, backing-block RB not following for the initial moment, but acting to let SM be compressed a bit against itself. In the next instant, the bulge will likely hve passed through the nip, and flexure F may begin to close the nip (i.e. return yoke Y and roll R-1 toward roll R-2). Block RB will not offer much resistance to this return (and may be experiencing some slight thrust as SM begins to "decompress"—indeed SM will "partly decouple" RB from the return-thrust of flexure F.)

Thereafter, with roll R-1 again normally biased against the rest of the passing document (by flexure F), elastomer SM will return to normal, along with block RB.

Anti-bounce elastomer SM thus will tend to damp-out a bounce of roll R-1 since it absorbs (at least some of) the energy acquired when R-1 and its yoke Y are suddenly thrust away from drive roll R-2—with block RB initially urging SM to be compressed. SM can later release this energy, (and return to its normal STATIC condition.) The mass for RB will depend on the stiffness of R-1, F and SM and weight of Y.

In some circumstances, it may be necessary to limit the motion of block RB to prevent interference with adjacent assemblies or to prevent unusually large stresses in the spring. The elastomer spring employed in this embodiment can also have substantial damping due to the chemical compounding of the elastomer. This will serve to limit both the stress in the spring and the motion of the block. Other "dynamic absorber" embodiments may use compression springs, etc., and/or these may require added damper elements well known in the art.

Now, somewhat related pinch-roll arrays are known in the art; e.g. see U.S. Pat. Nos. 4,875,670, 5,029,845, 4,974,680, 5,098,082, 3,353,879, 5,172,900, 5,172,900, 4,903,954, 4,346,883, 4,425,694. Many such systems have typically employed opposed pinch-rolls and, to accomodate variance in document thickness etc., some have used resilient means therewith.

Previous resilient elements, such as air dashpots, bushings, sliding contact devices, and magnetic devices, require small gaps between components—my dynamic absorber does not. These gaps collect paper dust which can interfere with normal functioning of the (moveable) pinch roller. Other devices employ flexible damping material in (on) the pinch roll (roller) itself. But this can cause overheating in the roller due to its constant rotation with a pinch load. R-1 may have a resilient surface itself.

Yet artisans have not, evidently, perceived, the need for, or utility of, a "floating damper" system ("dynamic absorber") as here taught (e.g. a dynamic absorber like SM, RB in FIG. 1). Interestingly, neither the floating spring means SM, nor the associated rigid backing means RB is workable alone. Using just a floating spring would have little or no effect by itself (e.g. it wouldn't compress); and a rigid mass like block RB would, by itself, be counter-productive (e.g. increased mass adding to bounce-excursion by roll R-1, and delay its return vs roll R-2).

And, "grounding" spring SM (e.g. vs a rigid bracket like B affixed on a machine frame) would make SM "non-floating" and is contra-indicated, since it not only would not help alleviate "bounce", but would also upset the prebias on R-1.

And, other "non-floating" expedients would not work in the indicated fashion e.g. adding spring means (or like resilient bias means) to urge arm F (and roll R-1) toward, or away from roll R-2.

Bracket B and arm F are preferably arranged to apply a pre-load force urging R-1 vs R-2 as known preferably along a line $L_1$—$L_1$ through the "nip", i.e. through pinch roll centers and the contact point between the two rolls. Line $L_1$—$L_1$ is generally perpendicular to the direction of document transport.

FIG. 2 shows a variation on FIG. 1 where the moveable roll 1 is mounted on a rigid arm 5 pivoted at P, with a flexure spring fl biased against arm 5 via a detent d-1 on arm 5 and with a like yoke y' for roll 1 plus a like floating damper for y', comprising elastomer thickness SM' plus rigid back-plate RB'.

FIG. 3 is yet a second variation, with the FIG. 2 embodiment modified by placement of bias flexure fl' to apply the bias more directly along the nip-line L1—L1.

The resilient pre-load force may otherwise be applied by any number of conventional means: coil spring, flexure, hydraulic cylinder, etc., as known in the art.

Once preload force Fp is applied, the moving roll R-1 (FIG. 1) will be urged into driving-contact with drive-roll R-2. When documents and/or protrusions thereon spread the rolls R-1, R-2, apart, arm F will be allowed to pivot resiliently about fixed bracket B.

Preferably this flexible material SM may comprise polyurethane, or certain rubber or other elastomers adapted), to resist any tendency of the pinch rolls to "spread apart", open the "nip" and lose contact with a document (i.e. to move normal to the document transport direction)—this being limited by this flexible characteristic, and resulting in the document remaining in more continuous, intimate contact with rolls R-1, R-2.

Elastomer pad SM will be compressed when an over-thickness anomaly, such as a staple, enters the "nip" and will quickly compress and store (at least some) bounce energy; then, later, SM can expand, while arm F urge the moveable roll R-1 back toward the driving roll R-2, once the anomaly has passed the nip. Elastomer pad SM should compress quickly, with constant force (no large return-force required) and without fatigue, degradation (e.g. overheating) or material failure, despite possible high-frequency service. Thus, pad SM should exhibit good elasticity (e.g. over small, high-frequency excursions and minor loads—but no great radial elasticity required). Pad SM can also be "high-damping" to better resist high-frequency excursions and very quickly return the moveable roll R-1 with little or no bounce—e.g. vs. a low-damping SM material that might tend more to "creep", or bounce or otherwise allow the nip to gradually "open" (be enlarged) by over-thickness documents and so degrade contact with a passing document. Preferred materials for pad SM like poly-urethane will be recognized as suitable by workers (e.g. such as also used for flat drive-belts or the like). In certain instances, another like resilient damping means SM may suffice.

Workers will appreciate the desireability of the pre-bias means, (e.g. imparted by flexure F) urging roll R-1 vs. drive roll R-2; and will understand that pad SM cannot provide this. Thus, pad SM works better in conjunction with a separate pre-bias means as indicated in FIGS. 1–3. A preferred example of such a pre-bias means is indicated by flexure arm F, (FIG. 1), or by flexure fl or fl' in FIGS. 2, 3.

FIG. 2 will be understood as functionally equivalent to FIG. 1, but indicating use of a rigid arm 5 with bias-flexure means fl (eg. leaf spring as known in the art) to bear against a cooperating bias-detent projection d-1 of arm 5 adapted to direct bias force Fp at nip between roll-centers as aforementioned.

But FIG. 2 is a special, less-preferred case with the bias flexure f-b, urging arm 5 and moving roll 1 vs. fixed drive roll 3, is applied vs a bias-extension d-1 which is "offset" from the nip-line L1—L1 between roll centers.

Also, damping means F-bb might ordinarily be viewed as helpful to damp vibration, of arm 5; eg. via suitable damping flexure means as workers will appreciate—yet with the elastomer SM' it isn't usually needed.

In FIG. 3, rolls 1, 3 are opposed, with moveable roll 1 mounted to rotate on the distal end of a composite arm 5, comprising a rigid distal section 5-1, coupled to a proximal resilient section (flexure leaf or the like) 5-2, which is cantilevered-out on a pivot fixture mounted to rotate on a fixed shaft P. The pivot fixture is preferably adapted to rotate loosely on shaft P until locked thereon (eg. by known means, such as set-screw means—not shown, but well known in the art).—This may be done after arm 5-1, 5-2 is rotated sufficient for moveable idler roll 1 to contact drive roll 3. Preferably, resilient arm segment 5-2 is also provided with damping means, as known in the art.

Moving idler roll 1 is mounted to rotate on its own fixed shaft on yoke Y' as before (as known in the art; not illustrated in detail here).

As in FIG. 2, FIG. 3 shows pre-bias means is also thus provided to resiliently urge moveable roll 1 into contact with drive roll 3 (eg. via flexure leaf fl', pushing yoke y'). Such a "compound" (rigid/flexible) mounting arm 5-1, 5-2 may be less preferred in some instances (vs. a fully-rigid arm as in FIGS. 2.

FIG. 3 shows a variation on FIG. 2 where a nip-bias flexure fl' is made to act along the nip-line L1—L1 (through the "nip", or rotation-center of rolls 1, 3; e.g. so that preload bias Fp can be applied directly along L1—L1.

The foregoing (and other like) dynamic floating absorber "roll-mount" embodiments will be seen as advantageously minimizing cost, assembly time etc., and will accommodate bulges and like nip-anomalies, while quickly reacting and maximizing contact with the passing document.

CONCLUSION

It will be understood that the preferred embodiments described herein are only exemplary, and that the invention is capable of many modifications and variations in construction, arrangement and use without departing from the spirit of the invention.

Since modifications of the invention are possible, for example the means and methods disclosed herein are also applicable to other pinch roll mounting arrangements, as well as to other related document-advance components; and it will be understood that the present invention is also applicable for enhancing other related sheet-advance arrangements (eg. document sorters, mail sorters, copiers, page feeders for printers, punch card transports, envelope stuffing machines, money feeders & transports in automatic teller machines.)

Examples given above of other possible variations of this invention are merely illustrative. Accordingly, the present invention is to be considered as including all possible modifications and variations within the scope of the invention as defined by and set forth in the appended claims.

What is claimed is:

1. A document transport array including pinch roll means, this array arranged to allow for a varied inter-document gap, and for varied-thickness documents, said pinch roll means including a moveable roll mounted on a block means which is mounted only on mount-spring means, to allow said moveable roll to be resiliently thrust away from the document path, said block means also including resilient block absorber means suspended therefrom and adapted to absorb energy and minimize motion developed normal to said path, thus enabling said moveable roll to better maintain contact with a transported document, while yet avoiding need for high pinch force means and for excess flexible material on the pinch rolls themselves.

2. The array of claim 1, wherein said moveable roll is mounted on said block means via shaft means which is fixed on said block means.

3. The array of claim 2, wherein said shaft means is so mounted with sealed ball bearings.

4. The array of claim 1, wherein said mount-spring means comprises planar flexure means cantileverd-out from rigid base means, and providing the pinch force.

5. The array of claim 4, wherein said absorber means comprises absorber spring means affixed on one side said block means plus rigid base means affixed on the opposite side of said absorber spring means.

6. The array of claim 1, wherein said absorber means comprises absorber spring means affixed on one side of said block means plus rigid base means affixed on the opposite side of said absorber spring means.

7. The array of claim 6, wherein said spring absorber means comprises elastomer pad means.

8. The array of claim 7, including limiter means adapted to limit the excursion of said block means and so prevent overstressing of said spring absorber means.

9. The array of claim 7, wherein said elastomer pad means comprising elastomeric material adapted to minimize base motion and spring stress.

10. A document transport array including pinch roll means, this array arranged to advance documents which effectively vary the thickness of documents, said pinch roll means including a moveable roll mounted on yoke means which is, in turn, mounted only on mount-flexure means, to allow said moveable roll to be resiliently thrust away from the document path in bounce-excursions, said yoke means also including dynamic absorber means suspended therefrom and adapted to absorb energy and minimize motion developed normal to said path, thus enabling said moveable roll to better maintain contact with a transported document, while yet avoiding need for high pinch force means and for excess flexible material on the pinch rolls themselves; said absorber means comprising compressible pad means affixed on a distal side of said yoke means plus rigid base means affixed on the opposite side of said pad means and adapted to resist said bounce excursions and thus compress said pad means, at least momentarily.

11. The array of claim 10, wherein said mount-flexure means comprises planar flexure means cantilevered-out from rigid base means, and providing the pinch force vs. the documents.

12. They array of claim 10, wherein said pad means comprises elastomeric material adapted to minimize roll motion and vibration, as well as spring stress.

13. A document transport array including pinch roll means arranged and adapted to rapidly advance documents while allowing for varied-thickness thereof, said pinch roll means including a moveable roll mounted on a mount means which is, in turn, suspended only on resilient mount-spring means, to allow said moveable roll to be resiliently thrust away from the document path, in bounce-excursions, said mount means also including floating damper means suspended therefrom and adapted to absorb energy and minimize motion developed normal to said path, thus enabling said moveable roll to better maintain contact with a transported document, while yet avoiding need for high pinch force means and for excess flexible material on the pinch rolls themselves; said damper means including compressible pad means affixed on one side of said mount means plus rigid base means affixed on the opposite side of said pad means and adapted to resist said bounce excursions and thus compress said pad means, at least momentarily.

14. The array of claim 13, wherein said mount-spring means comprises planar flexure means cantilevered-out from rigid base means, and providing the pinch force on the documents.

15. The array of claim 13, wherein said pad means comprises elastomeric material adapted to minimize vibration motion of said roll means.

* * * * *